US005112520A

United States Patent [19]

Krinski et al.

[11] Patent Number: 5,112,520

[45] Date of Patent: May 12, 1992

[54] METHOD FOR IMPROVING THE SOIL ANTI-REDEPOSITION PROPERTIES OF WASHING DETERGENTS AND PRODUCT

[75] Inventors: Thomas L. Krinski, Granite City, Ill.; Tam H. Tran, St. Louis, Mo.

[73] Assignee: Protein Technologies International, Inc., St. Louis, Mo.

[21] Appl. No.: 516,178

[22] Filed: Apr. 30, 1990

[51] Int. Cl.[5] ..... C11D 7/32; C11D 3/26; C11D 3/382; C11D 3/38

[52] U.S. Cl. ..... 252/174.23; 252/174.18; 252/527; 252/542; 252/524; 252/DIG. 2; 252/DIG. 13; 106/124

[58] Field of Search ..... 252/DIG. 15, DIG. 2, 252/DIG. 13, 174.18, 174.23, 527, 542, 524; 106/124

[56] References Cited

U.S. PATENT DOCUMENTS 4,474,694 10/1984 Coco ..... 106/124
4,689,381 8/1987 Krinski ..... 106/124

FOREIGN PATENT DOCUMENTS 0146395 6/1985 European Pat. Off. .

*Primary Examiner*—Paul Lieberman
*Assistant Examiner*—Kevin D. McCarthy
*Attorney, Agent, or Firm*—Cohn, Powell & Hind

[57] ABSTRACT

A detergent composition and method may have the soil anti-redeposition properties significantly and unexpectedly improved by incorporating into the detergent composition an effective amount of an anti-redeposition agent. The anti-redeposition agent is a modified vegetable protein material such as a soy protein isolate which has been modified with an ionic monomer. Ionic monomers which have been found to be especially effective at improving the anti-redeposition properties of washing detergent compositions are cationic epoxide monomers, cationic acrylate monomers and cationic chlorohydrin monomers. Anionic or carboxylated soy protein derivatives have also been shown to be effective anti-redeposition agents.

15 Claims, No Drawings

METHOD FOR IMPROVING THE SOIL ANTI-REDEPOSITION PROPERTIES OF WASHING DETERGENTS AND PRODUCT

BACKGROUND AND SUMMARY OF THE INVENTION

This invention relates to detergent compositions and methods of forming detergent compositions. The detergent compositions formed have greatly improved soil removal and/or anti-redeposition properties. These properties have been found to be unexpectedly improved by the addition of a modified vegetable protein material which provides greatly improved and unexpected anti-redeposition properties. Further, the modified vegetable protein material is rapidly biodegradable, thus significantly improving the environmental properties of the detergent as a whole.

Applicants are aware of the following U.S. Pat. Nos., the disclosures of which are incorporated by reference herein.

U.S. Pat. No. 3,000,830
U.S. Pat. No. 3,594,324
U.S. Pat. No. 4,352,692
U.S. Pat. No. 4,474,694
U.S. Pat. No. 4,689,381

Synthetic detergent compositions have been used commercially for many years for the removal of soil from fabric. These materials generally are combinations of a number of different compounds or additives. These compositions may include, although they are not necessarily limited to, an organic detergent compound such as a surfactant or surface active agent, builder components such as a phosphate salt which enhances the cleaning effectiveness of the surfactant by sequestering various metal ions found in hard water and also a soil suspending or anti-redeposition agent to help the surfactant hold the soil particles in suspension and prevent them from being redeposited onto the fabric during washing.

The use of a soil anti-redeposition agent generally improves the whiteness of fabrics washed with the detergent or the brightness of the color, since the anti-redeposition agent suspends the soil in the solution once it has been removed from the fabric and prevents its redeposition onto the washed fabric. If the detergent composition has poor soil suspension properties during washing and the soil is allowed to be redeposited or to settle from the wash water onto the washed fabric, the fabric will eventually acquire a gray or dull appearance, which is extremely undesirable aesthetically.

A number of materials have been used as soil anti-redeposition agents. One of the most widely used materials is carboxymethylcellulose. Carboxymethylcellulose has been added for a number of years to different types of detergent compositions used for washing fabrics to prevent redeposition of soil from solution once the soil has been removed from the fabric by washing. Other materials which have been proposed or used as soil anti-redeposition agents include sodium polyacrylate, polyvinyl acetate, ethylcelluloses, polyvinyl alcohols, sodium alginate and various modified starches. All of the above are generally regarded as being less effective than carboxymethylcellulose. Other types of soil anti-redeposition agents which have been described as having improved soil anti-redeposition properties over carboxymethylcellulose include polyvinylpyrrolidone, as described in U.S. Pat. No. 3,000,830, and a combination of carboxymethylcellulose and a gelatin protein as described in U.S. Pat. No. 3,594,324. While use of these materials as soil anti-redeposition agents in detergents has been somewhat successful, none the less, a need still exists for an improved material having better soil anti-redeposition properties and one which is readily adaptable and useful in a wide variety of detergent compositions. It is particularly desirable to develop a soil anti-redeposition agent which is more effective in liquid detergent compositions. Carboxymethylcellulose and ethylcelluloses, for example, and other state of the art redeposition agents, typically have very poor solubility in the solutions which make up liquid detergent compositions. As a result, these materials have very low effectiveness as soil anti-redeposition agents in liquid detergent compositions.

Applicants have found that a modified soy protein material, particularly a modified soy protein material which incorporates a cationic monomer, and in particular cationic chlorohydrin, epoxy and/or acrylate monomers, have unexpected soil anti-redeposition properties. Anionic soy protein which has ben carboxylated is also effective as a soil anti-redeposition agent. These soil anti-redeposition properties are observable when the material is used in liquid detergent compositions or in dry powdered detergent compositions. Moreover, these modified soy protein materials exhibit an unexpected improvement in soil anti-redeposition properties in many detergent systems. Applicants, anti-redeposition materials are effective in liquid and powdered detergents and in detergents used in cool and hot water. Applicants, anti-redeposition materials are effective when used with a variety of conventional washing detergent materials, including surfactants, builders and additives. Applicants, anti-redeposition materials are effective on a wide variety of soils and for a wide variety of fabrics.

It is therefore an object of the present invention to provide a method of improving the soil anti-redeposition properties of detergent compositions.

It is a further object of the present invention to provide a detergent composition which has greatly improved soil anti-redeposition properties.

It is also an object of the present invention to provide a method of improving the soil anti-redeposition properties of detergent materials by incorporating a modified soy protein compound in the detergent composition.

It is an object of this invention to improve the biodegradable properties of washing detergents.

It is an object of this invention to provide an anti-redeposition agent, for washing detergents, which is biodegradable.

It is an object of this invention to provide a modified protein soil anti-redeposition agent for washing detergents.

It is an object of this invention to provide an ionically modified soil anti-redeposition agent for washing detergents.

It is an object of this invention to provide cationically and anionically modified soy protein soil anti-redeposition agents for washing detergents and to provide a method using such soil anti-redeposition agents.

These and other objects will be apparent from the following Description of the Preferred Embodiments.

DESCRIPTION OF THE PREFERRED EMBODIMENTS

The unique material which is employed in the production of a detergent containing a soil anti-deposition agent is a modified vegetable protein material. In particular, applicants described in U.S. Pat. No. 4,689,381 are particularly advantageous. These materials are obtained by modifying an isolated vegetable protein material such as that obtained by alkaline extraction from a protein source and then reaction of the extracted protein material with a cationic monomer. Epoxide, chlorohydrin and acrylate cationic monomers have been found to be particularly suitable for use in this invention.

In another embodiment of the invention, applicants have found that anionic soy polymers, such as produced by the method of U.S. Pat. No. 4,474,694, are also highly useful. These products are obtained by reacting extracted protein material with an anionic monomer. Anionic phthlate monomers have been found to be particularly suitable for use in this invention.

A fairly conventional detergent composition may be used with applicants, anti-redeposition agents to prepare either a dry powdered detergent or a liquid detergent which exhibits unexpected soil anti-redeposition properties. Such a detergent composition may be formulated by employing an organic detergent substance or surfactant. The surfactant may be chosen from any of the conventional anionic, nonionic, amphoteric or zwitterionic surfactants, which can be used alone or in combination to produce a detergent composition containing applicants, anti-redeposition agent. The following description of materials represents only illustrations of the numerous detergents which can find application in the scope of the present invention with applicants, anti-redeposition agent.

The anionic organic detergent compounds or anionic surface active agents may include detergent compounds which contain an organic hydrophobic group and an ionic solubilizing group. Typical examples of ionic solubilizing groups are sulphonate, sulphate, carboxylate and phosphate. Examples of suitable anionic detergents which would fall within the scope of the invention include the water soluble salts of higher fatty acids or resin acids such as may be derived from fats, oils and waxes of animal or vegetable origin and the sulphated and sulphonated synthetic detergents. Also included in the class of suitable detergent compounds include suitable anionic detergents such as the higher alkyl aryl sulphonates such as the alkyl benzene sulphonates as well as the sulphates of higher alcohols such as sodium laurel sulphate and similar materials.

Nonionic synthetic detergent compounds do not ionize in solution and the whole molecule acts as a cleaning agent. Those compounds which can be generally or broadly used in the present invention can be broadly defined as compounds produced by the condensation of alkyloxide groups which are hydrophilic in nature with an organic hydrophobic compound which may be aliphatic or aromatic in nature. The most widely used class of nonionic synthetic detergents include those which are formed by condensing ethylene oxide or propylene oxide with a hydrophobic base. However, other suitable nonionic organic synthetic detergent compounds including the polyethylene oxide condensates of alkyl phenols, as well as condensation products of materials such as ethylene oxide and the product resulting from the reaction of propylene oxide with ethylene diamine, the condensation product of aliphatic alcohols with ethylene oxide, the long chain tertiary amine oxides and the long chain alkyl phosphates may all be used with applicants, invention.

Amphoteric synthetic detergent compounds can be described as derivatives of aliphatic secondary and tertiary amines. Examples of specific compounds within this general grouping are materials such as sodium-3-dodecylaminoproprionate. Amphoteric sufactants have both positive and negative centers and assume either a positive (cationic) or negative (anionic) charge depending on the pH of the solution.

Zwitterionic synthetic detergent compounds behave similarly to nonionic surfactants and can be described as derivatives of aliphatic quarternary ammonium phosphonium, halide and sulfonium compounds. Examples of specific compounds falling within this definition are materials such as N,N-dimethyl-N-hexadecyl amino propane-1-sulfonate. These latter compounds are especially preferred for detergent characteristics in relatively cool water.

The detergent composition of the present invention can further include typical but non-limiting ingredients to improve other properties of the detergent composition. Included within this grouping of materials include compounds such that are described typically as water soluble builder salts such as phosphates which are added for purposes of enhancing the cleaning power of the detergent composition. Furthermore, various other materials may also be present such as materials to improve detergency of the composition and modify the foaming properties in whatever manner desired as well as various optical brightening agents, fluorescent whitening agents and the like. Germicidal ingredients may also be added to improve the overall cleaning or disinfecting properties of the detergent composition of the present invention. The present invention is not intended to be limited by the exact contents of the detergent composition of the present invention since numerous materials are well known and well within the knowledge of those skilled in the art in the production of detergents.

The above general groupings of organic detergent compounds may be used singly or in combination in the practice of this invention with applicants, modified protein material. These materials represent specific illustrations of many of the numerous conventional organic detergent compounds or surfactants which can find application within the scope of the invention. These materials may be used in dry powdered washing materials or as liquid detergent washing materials, as known in the art, with the novel addition of applicants, soy protein material to produce washing compounds having unexpectedly improved anti-redeposition properties, and in particular to produce liquid detergent compounds having greatly improved soil anti-redeposition properties.

Moreover, applicants, modified soy protein material permits replacement of a substantial portion of the compounds making up washing detergents with a readily biodegradable material. This significantly reduces the period that effluent detergent washing material remain in the environment, since the conventional anti-redeposition materials which are replaced break down very slowly in the environment. Applicants, anti-redeposition agents may be used at levels of from about 0.2 to 5% by weight of the detergent composition, and typically would be used at a level of from about 0.5 to 2% by weight of the total formulation, though the amount is not critical. Since applicants, product will break down in the environment in a matter of days, rather than years for some petroleum base materials, a very significant and unexpected improvement in the environmental performance of the washing compound can be achieved.

The following examples are given to further illustrate the specific embodiments of the present invention and the improvements achieved thereby.

Example 1

An array of liquid detergent materials was formulated as follows:

8.3 parts Neodol 25-9 (TM, Shell Chemical)
16.7 parts sodium alkyl benzene sulfonate
73.0 parts water
2.0 parts anti-redeposition agent (The control did not contain an anti-redeposition agent.)

The anti-redepostion agents used were sodium polyacrylate, Sokalan HP-22 (TM BASF Corp.), a cationic chlorohydrin modified soy protein produced as described in Example 1 of U.S. Pat. No. 4,689,381, and an anionic soy phthalate protein produced as described in Example 2 of U.S. Pat. No. 4,474,694. The chlorohydrin modified soy protein is essentially a soy protein quaternary amine complex, for example, a soy protein modified by 3-chloro 2-hydroxypropyltrimethyl ammonium chloride, used herein, by 4-chlorobutene trimethyl ammonium chloride, or by 2, 3 epoxypropyltrimethyl ammonium chloride. An especially useful phthlate modified soy protein, used in this example, was obtained by the method of Example 2 of U.S. Pat. No. 4,474,694, but by heating the extracted soy protein for 90 minutes, instead of for 30 minutes. Phthlalic anhydride was added at a level of 10% by weight of the dispersion, instead of 7.5%. The precipitated curd was resolubilized using 12% $NH_4OH$ and 3% sodium silicate solution. 7% $H_2O_2$ was added and the mixture was reacted for 75 minutes at 130°-140° F. and pH 9.0-9.5. The mixture was spray dried to a fine powder. This product is commercially available from Protein Technologies, Inc. as RXP 52505 (TM).

The detergent compositions were evaluated for effectiveness in preventing the redeposition of soil on fabric during washing. Five replications of 3 × 3 inch white swatches of 100% cotton, 50/50 polyester/cotton and 100% polyester were impregnated with an emulsion of spangler soil and motor oil emulsified with triethanolamine. The swatches were then washed five cycles in a convention test washing machine. Wash temperature was 40° C. (or 25° C., as shown). Wash time was 20 minutes. The detergent concentration was 0.15% by weight of the wash water. The fabric was rinsed once per cycle with 10% of the wash liquor left in the swatches of fabric. The comparative results from Example 1 are set forth in Table 1.

Redeposition is reported as the difference between the reflectance of the white fabric swatches washed with the detergents containing anti-redeposition agents and the swatches washed in the control containing no anti-deposition agent. Higher numbers indicate less soil redeposited. Reflectance was measured by a Hunter Colorimeter Model #PC24 , using the Y index.

TABLE 1

| | Change in Redeposition with polymer | | | |
|---|---|---|---|---|
| Polymer | Wash T. °C. | Cotton | 50:50: Cotton:Polyester | Polyester |
| phthlate (anionic) | 25 | +1.8 | +2.1 | +5.5 |
| phthlate (anionic) | 40 | +1.2 | +3.5 | −1.0 |
| chlorohydrin (cationic) | 40 | +3.0 | +8.2 | +4.2 |
| Sodium poly-acrylate | 40 | +3.1 | +4.4 | +1.3 |
| Sokalan HP-22 | 40 | −0.1 | +1.5 | +9.5 |

EXAMPLE 2

An array of powered detergent materials was formulated as follows:

10.0 parts sodium alkyl benzene sulfonate
5.0 parts Neodol 25-9 (TM Shell Chemical)
6.0 parts sodium silicate
20.0 parts sodium tripolyphosphate
56.0 parts sodium sulfate
1.0 parts carboxymethyl cellulose
2 0 parts anti-redeposition agent (The control did not contain an anti-redeposition agent.)

The anti-redepostion agents used were those described in Example 1.

The detergent compositions were evaluated for effectiveness in preventing the redeposition of soil on fabric during washing by the procedure described for Example 1. The results from Example 2 are shown in Table 2.

TABLE 2

| | Change in Redeposition with polymer (2) | | | |
|---|---|---|---|---|
| Polymer (1) | Wash T. °C. | Cotton | 50:50: Cotton:Polyester | Polyester |
| phthlate (anionic) | 40 | +4.6 | +1.5 | −1.7 |
| chlorohydrin (cationic) | 40 | +4.1 | +3.2 | +3.1 |
| Sodium poly-acrylate | 40 | +4.6 | −2.2 | −2.4 |
| Sokalan HP-22 | 40 | +4.6 | +1.7 | +0.4 |

EXAMPLES 3

An array of powered zeolite detergent materials was formulated as follows:

5.0 parts Neodol 25-9 (TM, Shell Chemical)
25.0 parts Zeolite type A (alumino silicate complex, Ethyl Corp)
10.0 parts alkyl benzene sulfonate
51.0 parts sodium sulfate
6.0 parts sodium silicate
1.0 parts carboxymethyl cellulose
2.0 parts anti-redeposition agent (The control did not contain an anti-redeposition agent.)

The anti-redepostion agents used were those described in Example 1.

The detergent compositions were evaluated for effectiveness in preventing the redeposition of soil on fabric during washing by the procedure described for Example 1. The results from Example 3 are shown in Table 3.

TABLE 3

| Polymer (1) | Wash T. °C. | Change in Redeposition with polymer (2) Cotton | 50:50: Cotton:Polyester | Polyester |
|---|---|---|---|---|
| phthlate (anionic) | 40 | +2.7 | +7.7 | −3.0 |
| chlorohydrin (cationic) | 40 | +3.2 | +3.2 | +7.2 |
| Sodium poly-acrylate | 40 | +0.2 | +9.4 | +2.2 |
| Sokalan HP-22 | 40 | +1.9 | +9.0 | +3.5 |

It may be seen from the above data that the washing materials containing applicants, modified protein matrial significantly improved the anti-redeposition properties of the detergent materials containing the modified protein. Such increases are both significant and unexpected. In particular, applicants, modified protein material has been found to produce significant and unexpected soil anti-redeposition when used to prevent redeposition of soils on a broad spectrum of fabrics, including cotton, polyester and polyester containing fabric materials. Moreover, applicants, material is effective in all forms of washing materials, both liquid and powdered.

Although the present invention has been described relative to the specific embodiments set forth herein, it is intended to include within the scope of the present invention all reasonable equivalents, substitutions and modifications thereof as will be appreciated by one skilled in the art. Applicant is not to be limited by the embodiments given herein for purposes of illustration but only by the claims appended hereto and their equivalents.

We claim:

1. A laundry detergent having one or more surfactants and additive materials the improvement comprising, the addition of a soil anti-redeposition agent, which is a vegetable protein modified by reaction with an anionic or cationic monomer in an amount at least about 0.2% by weight to substantially reduce the amount of suspended soil which is redeposited on washed fabric during a wash cycle.

2. The laundry detergent of claim 1 wherein the vegetable protein is modified by reaction with a cationic monomer.

3. A laundry detergent having a surfactant and additive materials the improvement comprising the addition of a soil anti-redeposition agent, which is an epoxy modified soy protein, in an amount effective to substantially reduce the amount of suspended soil which is redeposited on washed fabric during a wash cycle.

4. A laundry detergent having a surfactant and additive materials the improvement comprising the addition of a soil anti-redeposition agent, which is an acrylic modified soy protein, in an amount effective to substantially reduce the amount of suspended soil which is redeposited on washed fabric during a wash cycle.

5. The laundry detergent of claim 1 wherein the laundry detergent is a liquid detergent.

6. The laundry detergent of claim 1 wherein the laundry detergent is a powdered detergent.

7. A laundry detergent having a surfactant and additive materials the improvement comprising the addition of a soil anti-redeposition agent which is a vegetable protein modified by reaction with a cationic monomer selected from the group consisting of 3-chloro 2-hydroxypropyl trimethyl ammonium chloride, 4-chlorobutene trimethyl ammonium chloride and 2, 3 epoxypropyltrimethyl ammonium chloride in an amount effective to substantially reduce the amount of suspended soil which is redeposited on washed fabric during a wash cycle.

8. The laundry detergent of claim 1 wherein the vegetable protein is modified by an anionic monomer.

9. A laundry detergent having a surfactant and additive materials the improvement comprising the addition of a soil anti-redeposition agent which is a vegetable protein modified by reaction with an anionic phthlate monomer in an amount effective to substantially reduce the amount of suspended soil which is redeposited on washed fabric during a wash cycle.

10. The laundry detergent of claim 1 wherein the soil anti-redeposition agent is biodegradable.

11. A method of improving the soil anti-redeposition properties of a laundry detergent comprising one or more surfactants, comprising adding to the laundry detergent, an anionic or cationic modified soy protein in an amount at least about 0.2% by weight to substantially reduce the amount of suspended soil which is redeposited on washed fabric during a wash cycle.

12. The method of claim 11 wherein the modified soy protein is biodegradable.

13. An improved laundry detergent in the form of a surfactant, and any additive materials, containing, as the improvement, an alkali extracted vegetable protein modified by reaction with an anionic or cationic monomer in an amount in the range of 0.2 to 5 percent by weight of the detergent effective to reduce substantially the amount of suspended soil which is redeposited on washed fabric during a wash cycle.

14. The laundry detergent of claim 13 wherein the cationic monomer is a cationic monomer selected from the group consisting of 3-chloro 2-hydroxypropyl trimethyl ammonium chloride, 4-chlorobutene trimethyl ammonium chloride and 2, 3 epoxypropyltrimethyl ammonium chloride.

15. The laundry detergent of claim 13 wherein the vegetable protein is modified by an anionic phthlate monomer.

* * * * *